US011247083B2

(12) United States Patent
Vandemark et al.

(10) Patent No.: US 11,247,083 B2
(45) Date of Patent: Feb. 15, 2022

(54) FIRE CONTAINMENT DEVICE AND KIT

(71) Applicant: CellBlock FCS, LLC, Standish, ME (US)

(72) Inventors: Dylan Francis Vandemark, Hiram, ME (US); Matthew Lloyd Vandemark, Hiram, ME (US)

(73) Assignee: CELLBLOCK FCS, LLC, Standish, ME (US)

( * ) Notice: Subject to any disclaimer, the term of this patent is extended or adjusted under 35 U.S.C. 154(b) by 101 days.

(21) Appl. No.: 16/454,800

(22) Filed: Jun. 27, 2019

(65) Prior Publication Data

US 2020/0001125 A1 Jan. 2, 2020

Related U.S. Application Data

(60) Provisional application No. 62/691,138, filed on Jun. 28, 2018.

(51) Int. Cl.

| | |
|---|---|
| ***A62C 2/06*** | (2006.01) |
| ***A62C 99/00*** | (2010.01) |
| ***A62C 3/00*** | (2006.01) |
| ***A62C 8/00*** | (2006.01) |

(52) U.S. Cl.

CPC ..... *A62C 2/06* (2013.01); *A62C 3/00* (2013.01); *A62C 8/00* (2013.01); *A62C 99/0009* (2013.01)

(58) Field of Classification Search

CPC ..... A62C 19/00; A62C 35/08; A62C 35/10; A62C 2/00; A62C 2/06; A62C 2/065; A62C 3/00; A62C 3/16; A62C 8/00; A62C 99/0009; A62C 99/0045; A62C 99/009

USPC ..... 169/26

See application file for complete search history.

(56) References Cited

U.S. PATENT DOCUMENTS

| | | | | |
|---|---|---|---|---|
| 3,486,563 | A * | 12/1969 | Cholin | A62C 8/06 169/26 |
| 6,572,948 | B1 * | 6/2003 | Dykhoff | A62C 2/065 169/56 |
| 8,544,670 | B2 * | 10/2013 | Brilmyer | H01M 50/394 220/88.1 |
| 9,180,324 | B2 | 11/2015 | Burkett | |
| 9,339,671 | B1 | 5/2016 | Raj et al. | |
| 9,415,248 | B2 * | 8/2016 | Donahue | A62C 99/0009 |
| 9,578,942 | B2 * | 2/2017 | Brilmyer | A45C 11/00 |
| 9,597,535 | B2 * | 3/2017 | Knijnenburg | A62C 31/28 |
| 9,643,036 | B2 | 5/2017 | Burkett | |
| 9,725,365 | B1 * | 8/2017 | Zubrod | C04B 24/14 |
| 9,786,883 | B2 * | 10/2017 | Nubbe | H01M 2/1077 |
| 10,722,741 | B2 * | 7/2020 | Lian | A62C 3/16 |

(Continued)

*Primary Examiner* — Darren W Gorman

(74) *Attorney, Agent, or Firm* — Shlesinger, Arkwright & Garvey, LLP

(57) ABSTRACT

The invention is a container having an opening at one end and a flap or other closure to close the opening, the interior of the bag includes a liner filled with free-flowing expanded glass granulate having fire extinguishing properties, the liner is compartmentalized to separately retain the free flowing granulate to defined regions of the bag interior and it is formed from a sacrificial material that is combustible and will disintegrate upon exposure to the heat of a fire whereby when a electronic or other device that has caught fire is placed inside the bag, the free-flowing expanded glass granulate contained by the liner is caused to be released onto the device to extinguish the fire.

20 Claims, 11 Drawing Sheets

(56) References Cited

U.S. PATENT DOCUMENTS

| | | | | |
|---|---|---|---|---|
| 2011/0079456 | A1* | 4/2011 | Borumand | B32B 5/02 180/68.5 |
| 2012/0231317 | A1* | 9/2012 | Shimizu | H01M 2/105 429/120 |
| 2014/0209331 | A1* | 7/2014 | Burkett | A62C 8/00 169/46 |
| 2015/0069068 | A1* | 3/2015 | Hariram | B60K 1/04 220/560.01 |
| 2016/0211495 | A1 | 7/2016 | Haynes et al. | |
| 2016/0315361 | A1* | 10/2016 | Petzinger | H01M 2/1094 |
| 2017/0047564 | A1 | 2/2017 | Bianchi et al. | |
| 2017/0110757 | A1* | 4/2017 | Pasewald | C03C 11/002 |
| 2017/0155103 | A1* | 6/2017 | Pasewald | C03C 11/002 |
| 2017/0166394 | A1 | 6/2017 | Baylay | |
| 2017/0274231 | A1 | 9/2017 | Burkett | |
| 2017/0314835 | A1 | 11/2017 | Howland et al. | |
| 2017/0340909 | A1* | 11/2017 | Basham | A62C 3/06 |

* cited by examiner

FIG. 5
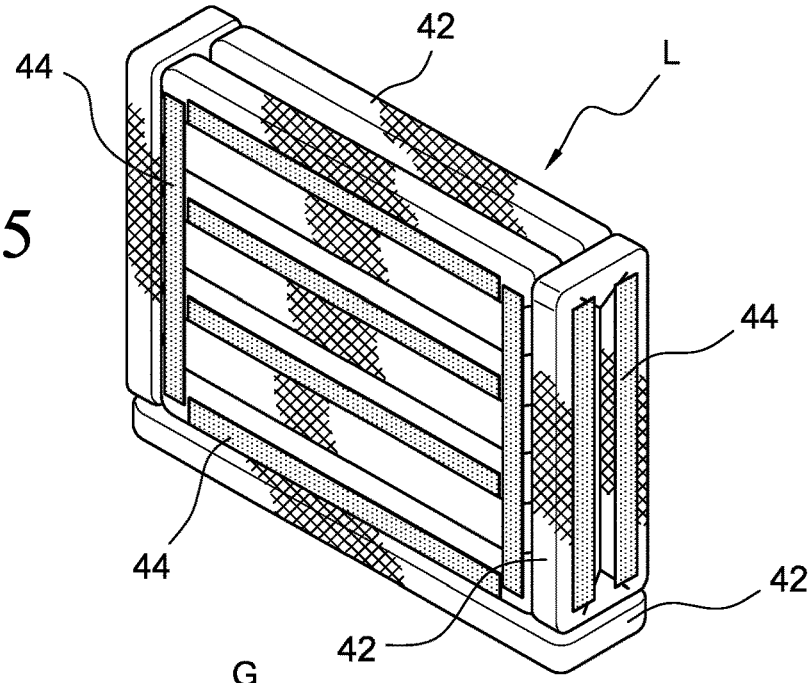
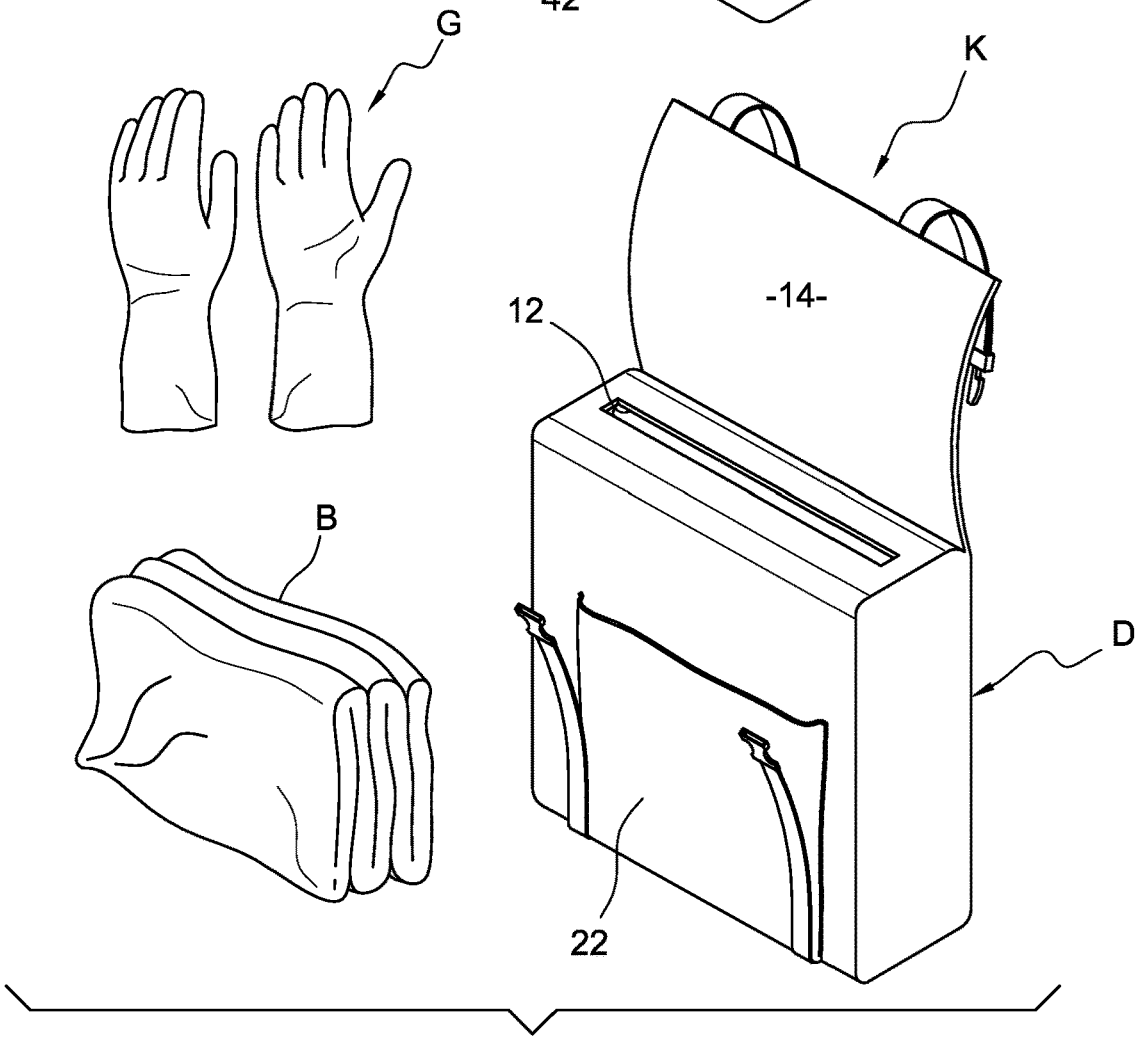
FIG. 6

FIRE CONTAINMENT DEVICE AND KIT

CROSS-REFERENCE TO RELATED APPLICATIONS

This application claims the benefit of priority from U.S. Provisional Application Ser. No. 62/691,138 filed on Jun. 28, 2018, which is incorporated herein by reference.

FIELD OF THE INVENTION

The present invention relates to a fire containment device for receiving and extinguishing a portable electronic device or other lithium-ion battery powered device that has caught fire.

BACKGROUND OF THE INVENTION

Portable electronic devices (PEDs), such as smart phones, tablet computers, laptops, e-readers, MP3 players, and electronic toys, are powered by lithium-ion batteries. When improperly handled, manufactured or overcharged, lithium-ion batteries are subject to thermal runaway i.e. the battery spontaneously increases in temperature and begins to vent hot and toxic pressurized gases. This causes the lithium-ion fluid within the battery to ignite and reach temperatures in excess of 2,000 degrees Fahrenheit. While it is possible to extinguish the flames by applying large amounts of water, the lithium inside of the battery may react with the electrolytes and water to generate hydrogen which can accelerate the fire. Sand or other granular minerals can be applied to a lithium-ion battery fire; however, these materials are fire resistant only and do not provide fire extinguishing properties. Accordingly, application of granular minerals to a lithium battery fire is unreliable, ineffective, or impractical.

A lithium-ion battery fire occurring on an aircraft can be catastrophic for obvious reasons. The smoke and toxic vapors alone could create panic on the flight deck and in the passenger cabin. It is therefore critical to provide a means on the aircraft to safely isolate and quickly extinguish a fire of this nature. Current FAA guidelines recommend applying water to a lithium battery fire. However, a sufficient volume of water is not readily available during a flight nor can water be quickly and effectively applied to a lithium-ion battery fires. Although conventional fire extinguishers are provided on an aircraft, they have limited effectiveness against lithium-ion battery fires.

It is known to provide a bag constructed from fireproof and/or fire resistant material to receive an ignited PED and presumably prevent the fire from spreading. Some of these devices use water to cool the ignited battery or chemicals to extinguish the fire. However, none of these devices suppress the fire nor are they capable of containing the heat, smoke or toxic vapors generated when a PED has burst into flames.

A need has therefore existed for a device that allows a user to quickly isolate a PED that has caught fire, prevent the fire from spreading and absorb the smoke and toxic vapor generated during the fire.

BRIEF SUMMARY OF THE INVENTION

The present invention is a device for containing a lithium-ion battery powered PED that has caught fire and extinguishing the fire, the device comprises a container or bag having an opening at one end and a flap or closure for sealing the opening, the interior of the bag includes a liner filled with free-flowing expanded glass granulate having fire extinguishing properties, the liner is compartmentalized to separately retain the free flowing granulate within defined regions and is formed from a sacrificial material that is combustible and will disintegrate when exposed to the heat of a fire whereby when a PED that has caught fire is placed into the bag, the free-flowing expanded glass granulate contained by the liner is caused to be released onto the PED to extinguish the fire and absorb the smoke and gases. In another embodiment, the container is provided as part of a kit that may include tongs, gloves and a blanket to assist a user in placing an ignited PED into the bag or container and securing it into a closed position.

BRIEF DESCRIPTION OF THE SEVERAL VIEWS OF THE DRAWINGS

FIG. 5 is a perspective view of the liner for the fire containment device;

FIG. 6 is another embodiment of the present invention showing the fire containment device as part of a kit;

DETAILED DESCRIPTION OF THE INVENTION

Figure 1:
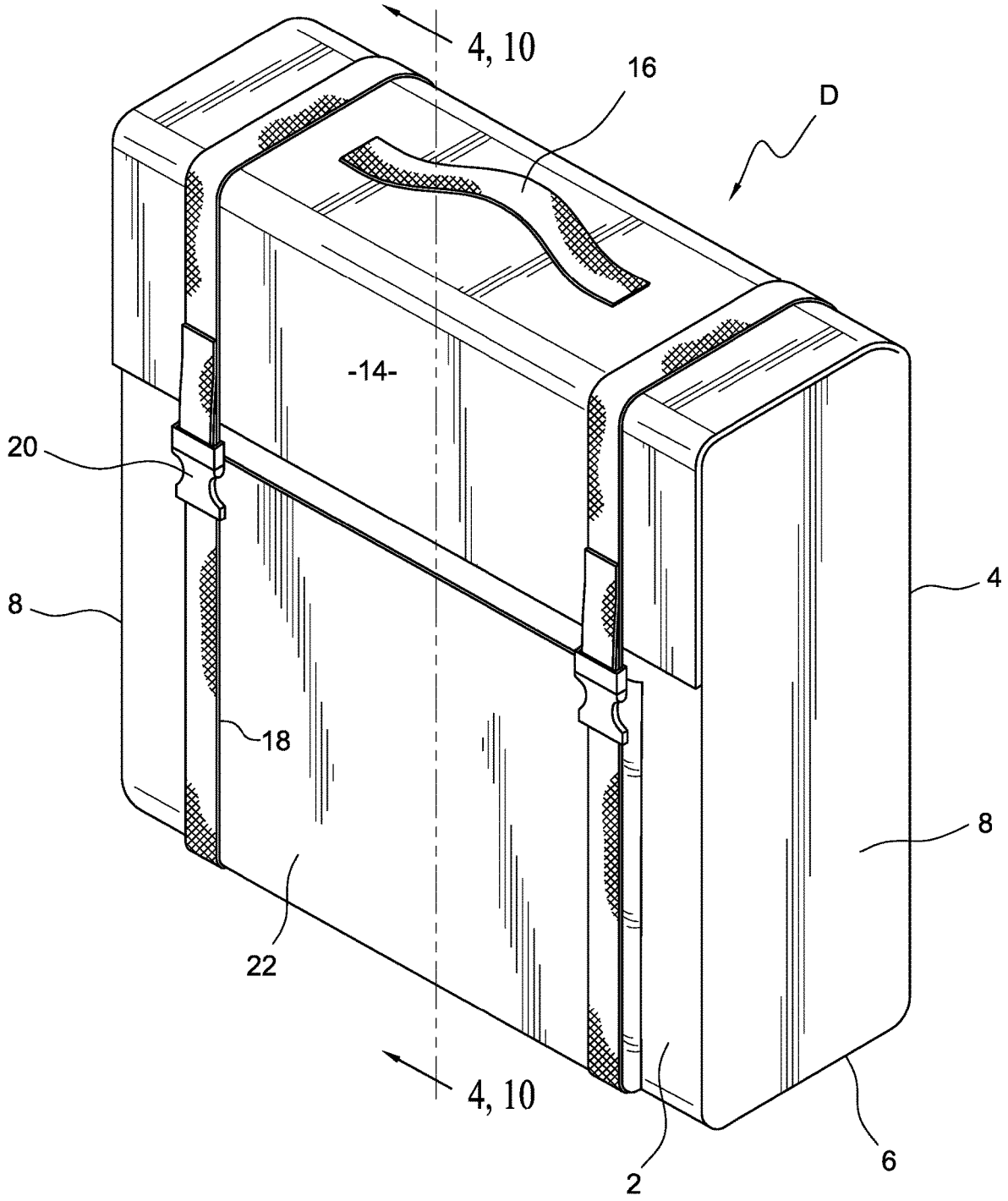
FIG. 1 is a perspective view showing the fire containment device according to the present invention when in a closed position.
Figure 2:
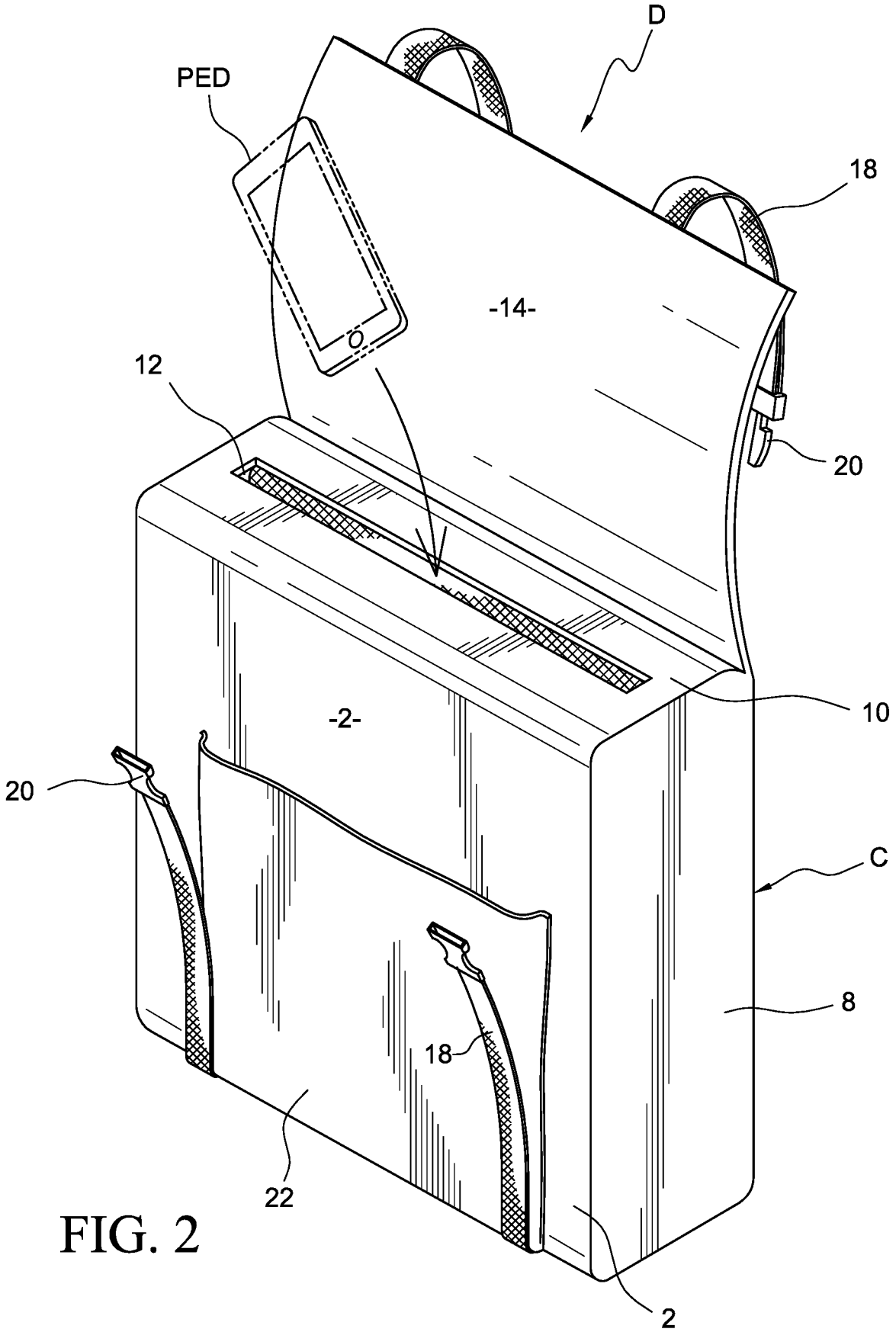
FIG. 2 is perspective view showing an embodiment of the fire containment device according to the present invention when in an open position and with a PED shown in phantom lines.

FIGS. 1 and 2 illustrates a device D according to the present invention for isolating and extinguishing a PED that has caught fire. The device D is a container or bag C having a front 2, back 4, bottom 6 and sides 8. The container top 10 is provided with an opening shown in the FIG. 2 embodiment to be a slot 12. The device D includes a closure or flap member 14 that extends from the top of the bag C to selectively seal off or otherwise close the opening or slot 12 as will be further explained below. The opening 12 is not restricted to any size of shape and it is within the scope of the present invention to provide other openings so long as the PED can be readily placed within the interior of the container C. A handle 16 may be provided together with a pair of straps 18 including buckles 20 for securing the closure 14 after the opening to the bag is closed by the flap 14. In a preferred embodiment the straps and handles are constructed from NOMEX brand webbing which is a flame resistant meta-aramid fabric material. Other flame resistant webbing materials are within the scope of the present invention. A sleeve 22 may be provided on the front 2 of the bag for receiving a fire blanket or other accessory as will be further explained below.

Figure 3:
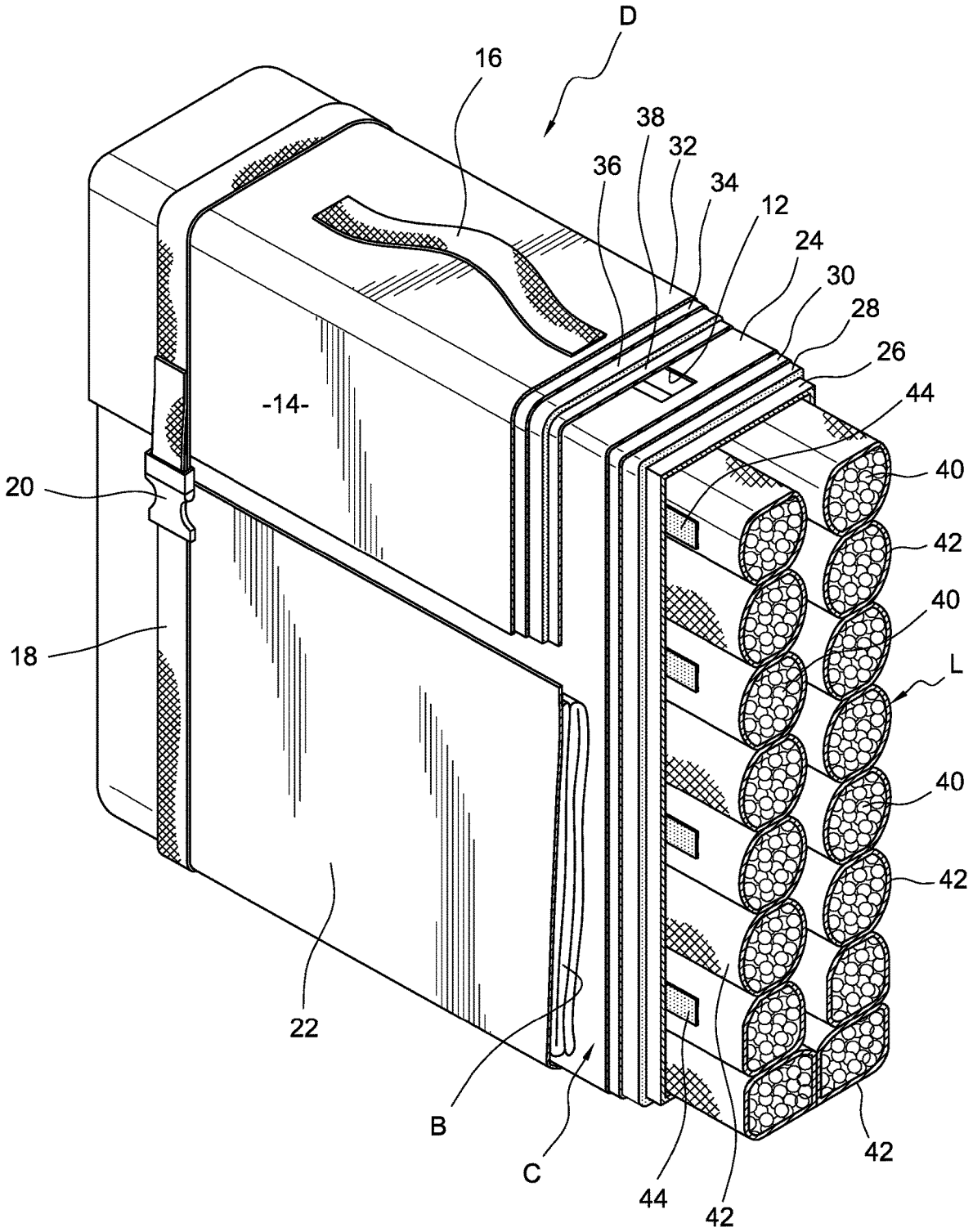
FIG. 3 is a perspective view of the device shown in FIG. 1 with portions broken away to expose the underlying layers.

Turning to FIG. 3, the construction of the container C and its flap member 14 are shown in greater detail. The exterior shell or outermost layer 24 of the container C is constructed from the above described meta-aramid fabric having flame resistant properties. Other materials having similar flame resistant properties are within the scope of the present invention. The innermost layer 26 of container C is a vermiculite treated fiberglass mat. This layer is capable of sustaining temperatures of about 1500 degrees Fahrenheit and provides the greatest heat resistance to the device D. In addition to its providing an interior shell having extreme temperature resistance, it is structurally the most rigid layer of the container C and its rigidity imparts structural support to device D so that it is self-supporting and can maintain an upright position.

A layer 28 is disposed on top of the innermost layer 26. Layer 28 is a silica fiber mat having a high R-value. Layer 28 ensures the exterior of the container C does not overheat during a fire event. This layer is preferably ½ inch in thickness and is capable of withstanding up to 1500 degree Fahrenheit temperatures without degradation. Silica mats having a high R-value within the scope of the present invention for use as layer 28 include those commercially available for use and placement to the exterior of a kiln or similar oven. Although this layer is delicate and fragile to the touch, it is sandwiched within the layers forming the container C and it provides the greatest heat insulation to the device D.

Sandwiched between layer 28 and the outermost layer 24 is a silicone-coated fiberglass fabric 30 that is preferably heat rated for sustained 1000 degree Fahrenheit exposure. This layer is relatively fragile in and of itself but its disposition between the innermost 26 and outermost 24 layers protects it from damage and does not degrade its desired heat resistant property.

Layers 24, 26, 28 and 30, which form the container C portion of the Device D, are sewn together with temperature resistant KEVLAR thread. Exposed seams from the thread may be lined with temperature resistant webbing material such as NOMEX.

The layers forming the flap 14 are as follows. The outermost flap layer 32 is constructed from the above described NOMEX brand webbing which is a flame resistant meta-aramid fabric material. Other flame resistant webbing materials are within the scope of the present invention. Underlying and adjacent the outermost flap layer 32 is interior flap layer 34 which comprises a silicone-coated fiberglass fabric that is preferably heat rated for sustained 1000 degree Fahrenheit exposure. This layer is preferably the same materials as layer 30 noted above. Underlying the interior flap layer 34 is a second interior flap layer 36 in the form of a silica fiber mat having a high R-value. Layer 36 ensures the exterior of the container C does not overheat during a fire event. This layer is preferably ½ inch in thickness and is capable of withstanding up to 1500 degree Fahrenheit temperatures without degradation. Silica fiber mats having a high R-value within the scope of the present invention for use as layer 36 include, for example, those commercially available for use and placement to the exterior of a kiln or similar oven. Although this layer is delicate and fragile to the touch, it is sandwiched within the layers forming the overall flap. The bottom flap layer 38 is a flexible carbon and acrylic coated fiber glass fabric that sufficiently reflect any heat exiting opening 12 during a fire event and therefore prevents the exterior of the flap from overheating. Flap layers 32, 34, 36 and 38 are sewn together with temperature resistant KEVLAR thread. Exposed seams from the thread may be lined with temperature resistant webbing material such as NOMEX.

Figure 4:
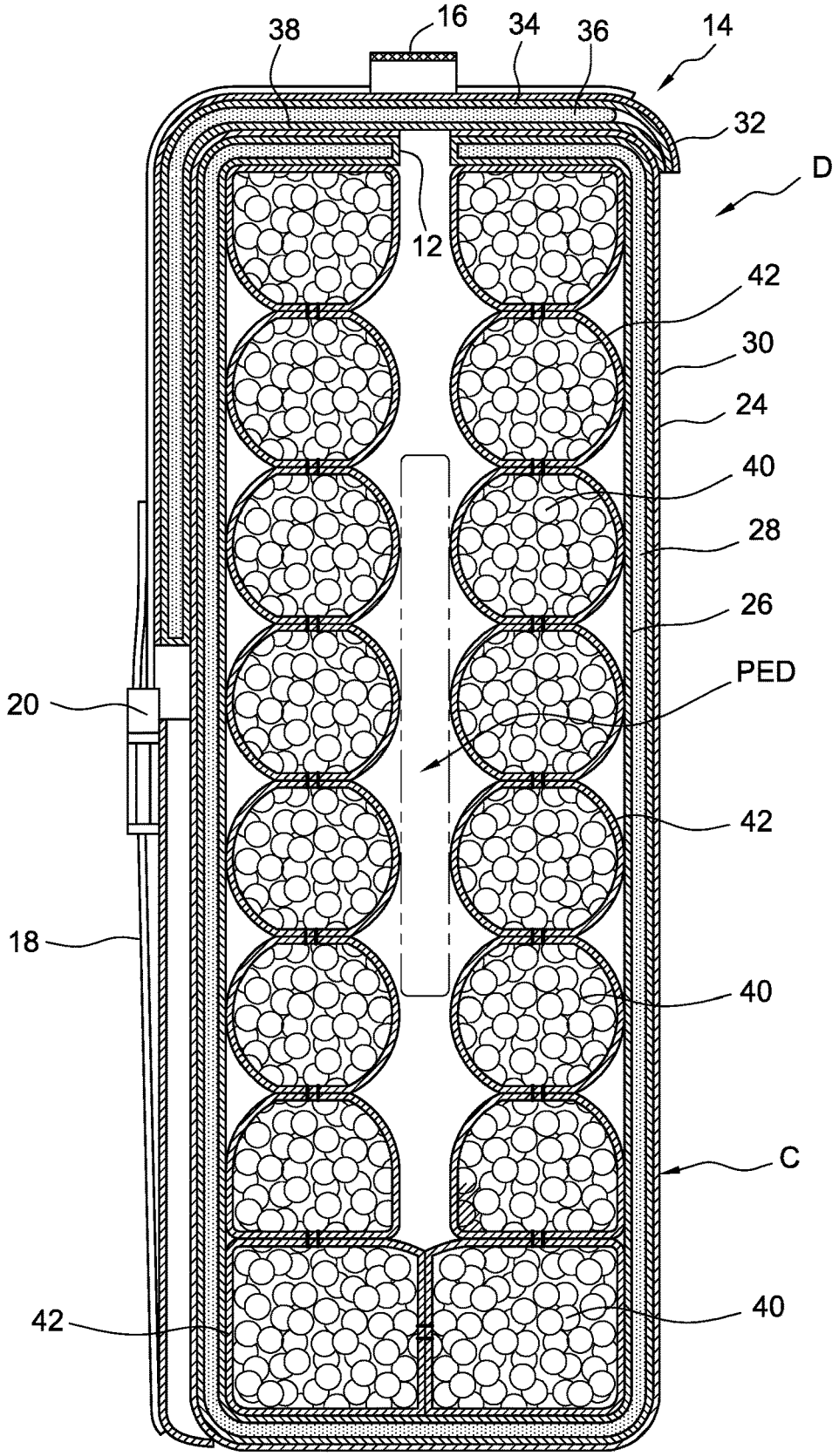
FIG. 4 is a cross-sectional view of the fire containment device shown in FIG. 1, taken along lines 4-4 with a PED inside the device shown in phantom lines.
Figure 7:
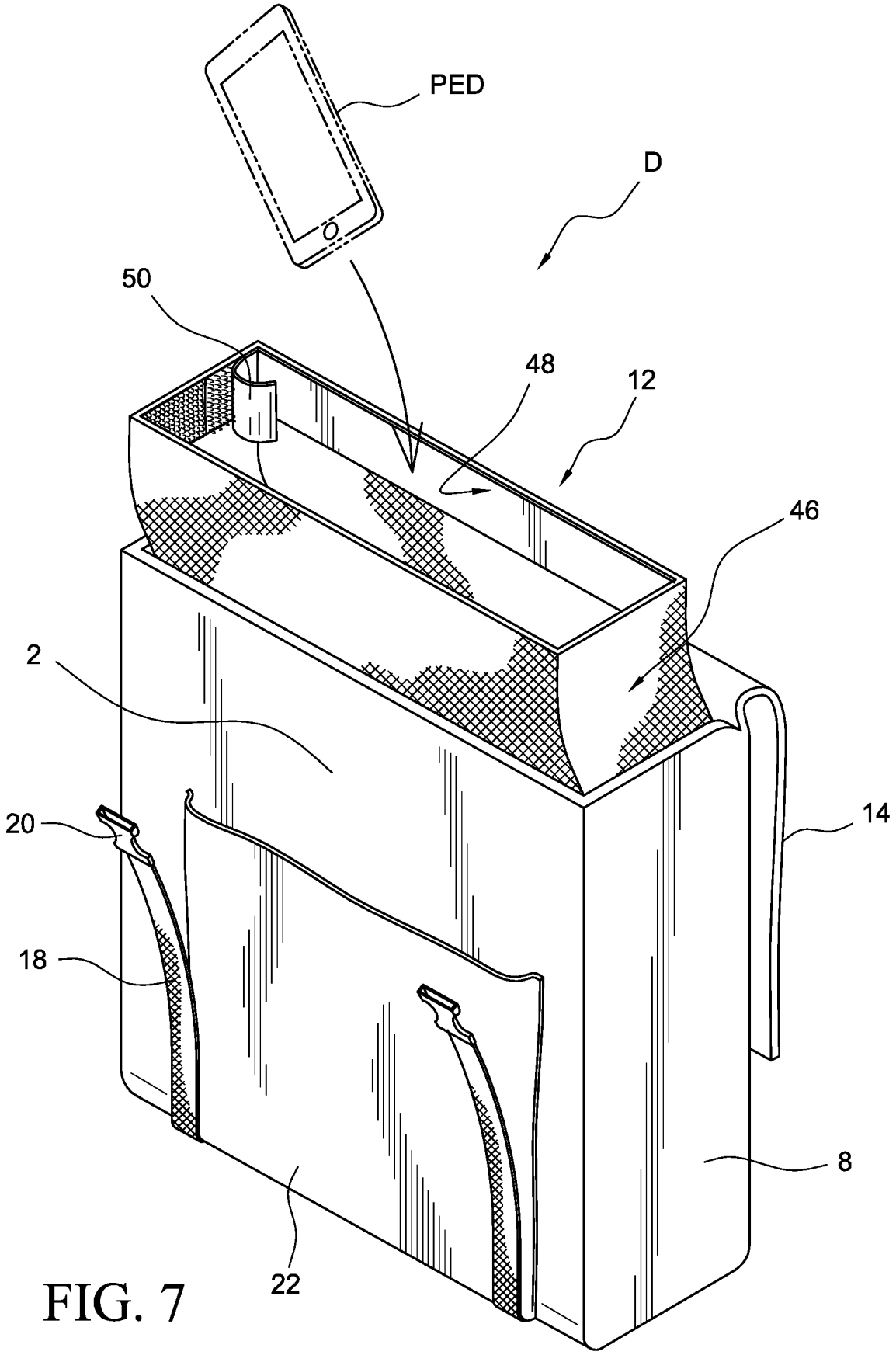
FIG. 7 is a perspective view of another embodiment of the fire containment device according to the present invention.

Turning to FIGS. 3, 4 and 5, the interior region of the device D is shown in greater detail, the interior region is shown to be lined with free-flowing expanded glass granulates 40 having fire extinguishing and smoke absorbing properties. The liner L, which holds the loose-fill glass granulate 40, is constructed from a heat sensitive material that is combustible and will quickly disintegrate when exposed to a flame or high heat.

In a preferred embodiment the liner L is constructed from a 100% polyester fabric that has been coated with a PVC resin to increase its sensitivity to heat and flame. Other flammable fabrics and materials (e.g. cotton) are within the scope of the invention.

As best shown in FIGS. 3, 4 and 5 the liner L comprises a series of distinct baffles or compartments 42 that are shown in the figures to be tube-shaped and aligned in a parallel relation to each other to provide a generally U-shaped construction. It is within the scope of the invention to provide other shapes and arrangements for the liner L and its compartments 42 so long as the free flowing granulate contained in the liner is prevented to shifting or accumulating in any region of the liner and is maintained in a uniformly distributed manner throughout the liner.

For example, the tubular compartments shown in the drawings may be square shaped or zig-zag shaped rather than tubular and linear as shown. While it is preferred to provide multiple compartments within the liner L to uniformly distribute the free flowing granulate throughout interior of the container C, the invention can function without compartments. The liner can be variable in size depending upon the size of the device D. The compartments can be formed individually and then sewn together with thread to provide a liner L as generally shown in FIG. 5. The liner L is secured to the interior of the container using VELCRO or other hook and loop attachment means 44 that has been preferably approved by the FAA for purposes of fire resistance.

The compartments 42 of the liner L are filled with free flowing expanded glass granules 40. The granules are relatively small, lightweight spheres of expanded (i.e. foamed) silicon dioxide glass having interior pores that provide a closed cell structure and about 70-80% air by volume. The granules readily absorb the heat and smoke and actively extinguish the fire by displacing oxygen and melting onto the ignited PED. The size of the aggregate correlates to the interior pore size and hence its relatively low density that enhances its utility as a reactive extinguisher. A commercially available expanded glass granulate suitable for use in the present invention is sold by Dennert Poraver GmbH under the EXTOVER trademark which is incorporated herein by reference.

The size of the expanded glass granulate in the present invention is preferably non-uniform and comprises a blend of different size granules. The smallest size granules have relatively greater density and a smaller pore size while the largest sized granules have the lower density and a larger pore size. In a preferred embodiment, the size of the loose fill granulate is between about 1 mm diameter to about 4 mm in diameter. A suitable composition for the granulate is a blend of 1 mm, 2 mm, 3 mm and 4 mm diameter size spheres combined in a 1:1:1:1 ratio. The preferred blend has a total air content of about 70-80% by volume and an average density of about 10 bs/ft^3 to promote sufficient absorption of the liquid electrolyte in an ignited battery, provide enhanced insulative properties from the heat of the fire and also provide low heat transference. The intense heat generated by a lithium battery fire causes at least some of the granules to melt which encases the PED as the fire is smothered and extinguished.

The use of compartments 42 within the liner L to individually retain the free-flowing granulate serves several functions. It evenly distribute the granulate 40 throughout the liner L and maintains its shape and structure and prevent excessive accumulation of the free flowing granulate within portions of the liner L. Without the compartments the liner would be too flexible and amorphous and thus, not release the granules on a PED fire in a controlled and evenly distributed manner. Compartments that are not sufficiently heated to release granulate onto a PED fire remain unopened and provide ballast to keep the device D surrounded by the fire suppressant granulate.

In the event of a PED fire and as best shown in FIG. 2, flap 14 is opened, the PED is deposited into the interior of the container or bag C by dropping it through the opening or slot 14 and the container is then closed using the flap. The sacrificial nature of the liner material enables it to disintegrate due to the heat of the PED fire which then releases the expanded glass granulate directly on the PED in an unrestricted manner. The expanded glass granulates absorb the gas and smoke generated by the fire including any electrolyte and cause the fire to be extinguished.

As best shown in FIG. 6, the device D according to the present invention may be provided in kit form which includes fire resistant gloves G, a supplemental fire resistant blanket B and tongs (not shown) for handling a PED that has ignited so that it may be disposed within container portion C of device D. The exterior sleeve 22 is provided to receive and store the fire blanket and/or the gloves or other supplemental tools useful to handle the PED on an aircraft.

Turning to FIGS. 7 through 11, another embodiment of the present invention is shown. In this embodiment, the opening 12 for access to the interior of the device D is provided in the form of a sleeve-like extension 46 that projects upwardly from the top 10 of container C. The extension may be formed from the layers described above with respect to the flap portion 14, but is additionally provided with a closure means 48, shown in the figure to be a length of hook and loop type connector, otherwise known as VELCRO, provided around the interior circumference of the sleeve-like extension 46. As is apparent, half of the inner circumference closure means strip is the hook portion of the VELCRO device while the remaining half of the inner circumference closure means strip is the loop portion of the VELCRO device. A covering strip 50 overlies either the hook or the loop section of the closure means 48 (or both).

Figure 8:
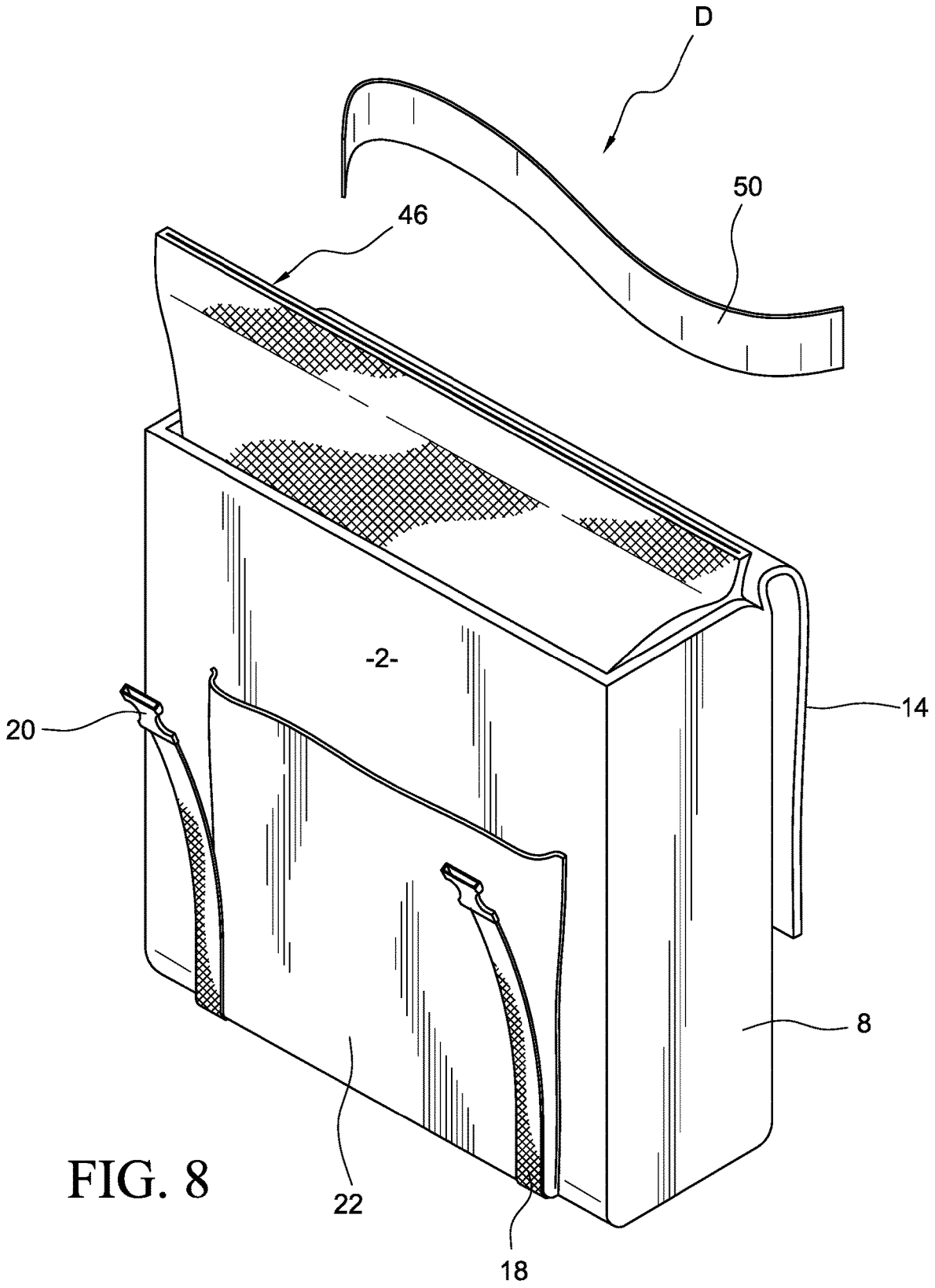
FIG. 8 is a perspective view of the device shown in FIG. 7 with the opening sealed.
Figure 9:
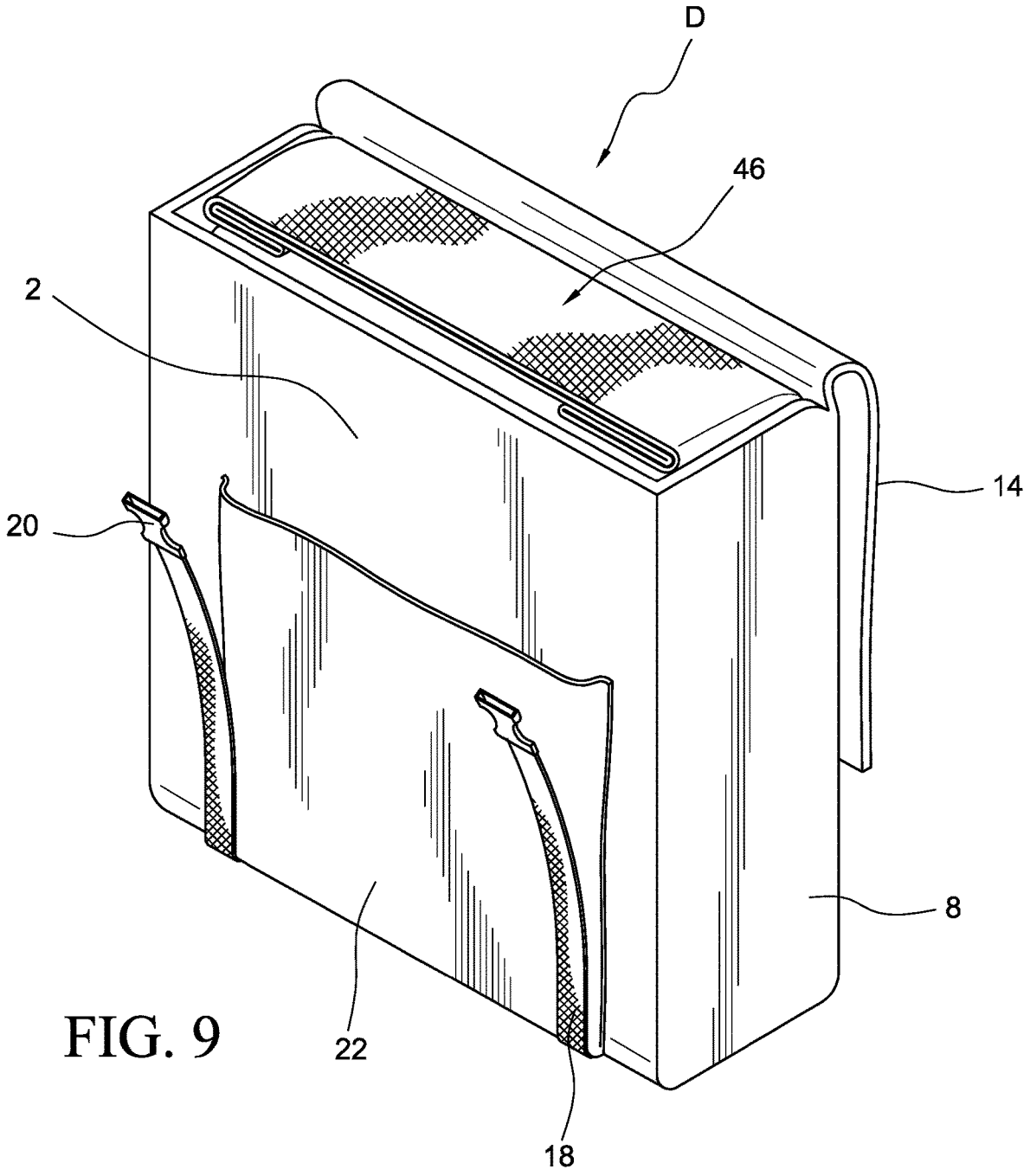
FIG. 9 is a perspective view of the device shown in FIG. 8 with the sealed opening in a folded position.
Figure 10:
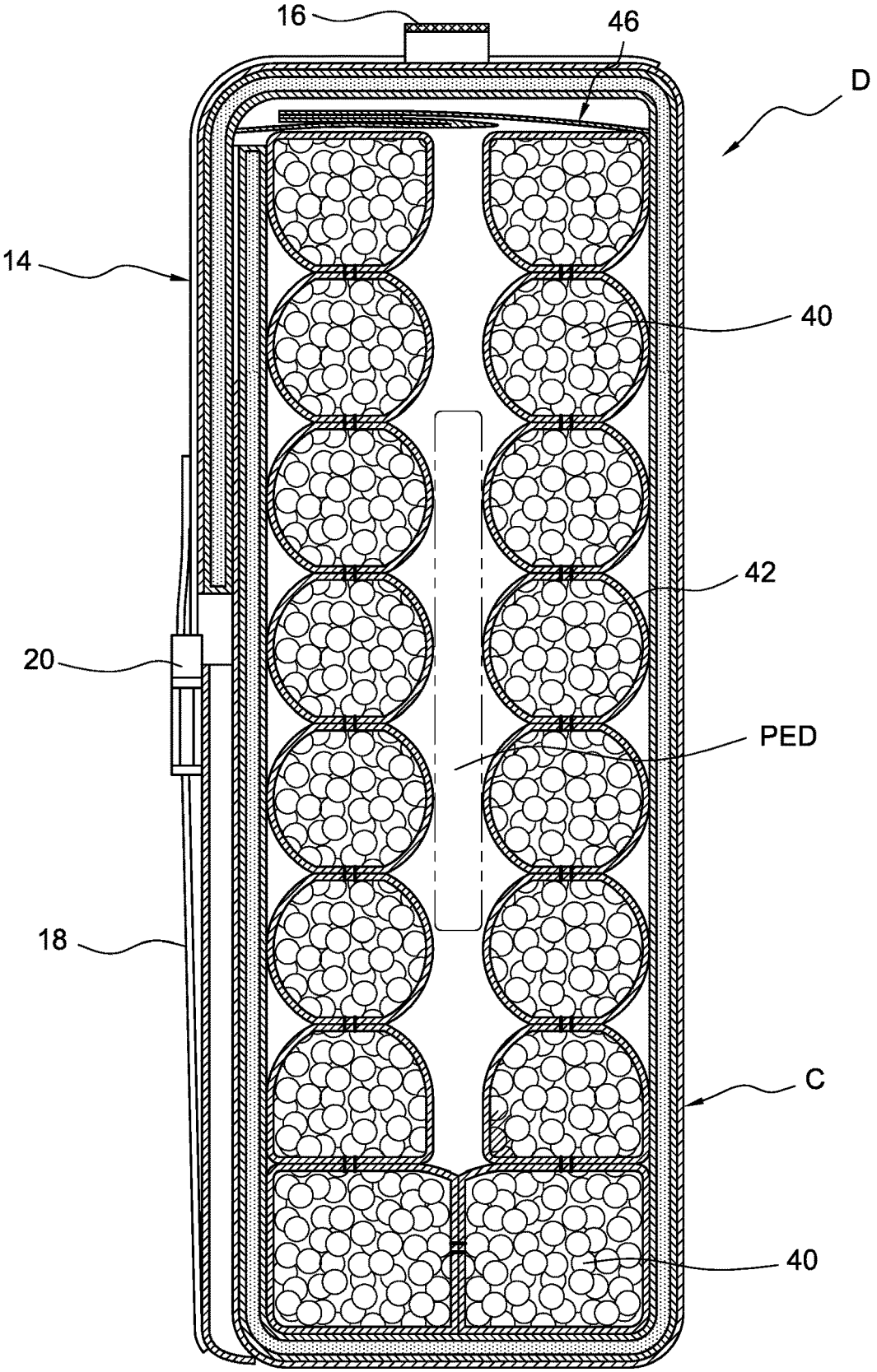
FIG. 10 is a cross sectional view of the device shown in FIGS. 7, 8 and 9 taken along lines 10-10 of FIG. 1.

During a PED fire event, a user will open flap 14 to gain access to opening 12 and then place the ignited PED within the interior of device D. The covering strip 50 is removed from closure means 48 and the ends of the sleeve like extension 46 are joined together to form a seal as best shown in FIG. 8. The sealed sleeve-like extension 46 is then folded over, as best shown in FIGS. 9 and 10, followed by closing of the flap 14 which is then re-buckled. This embodiment adapts the device D to receive a PED of varying size and shape and effectively seals the interior of the bag to prevent any smoke and gases from escaping device D.

Figure 11:
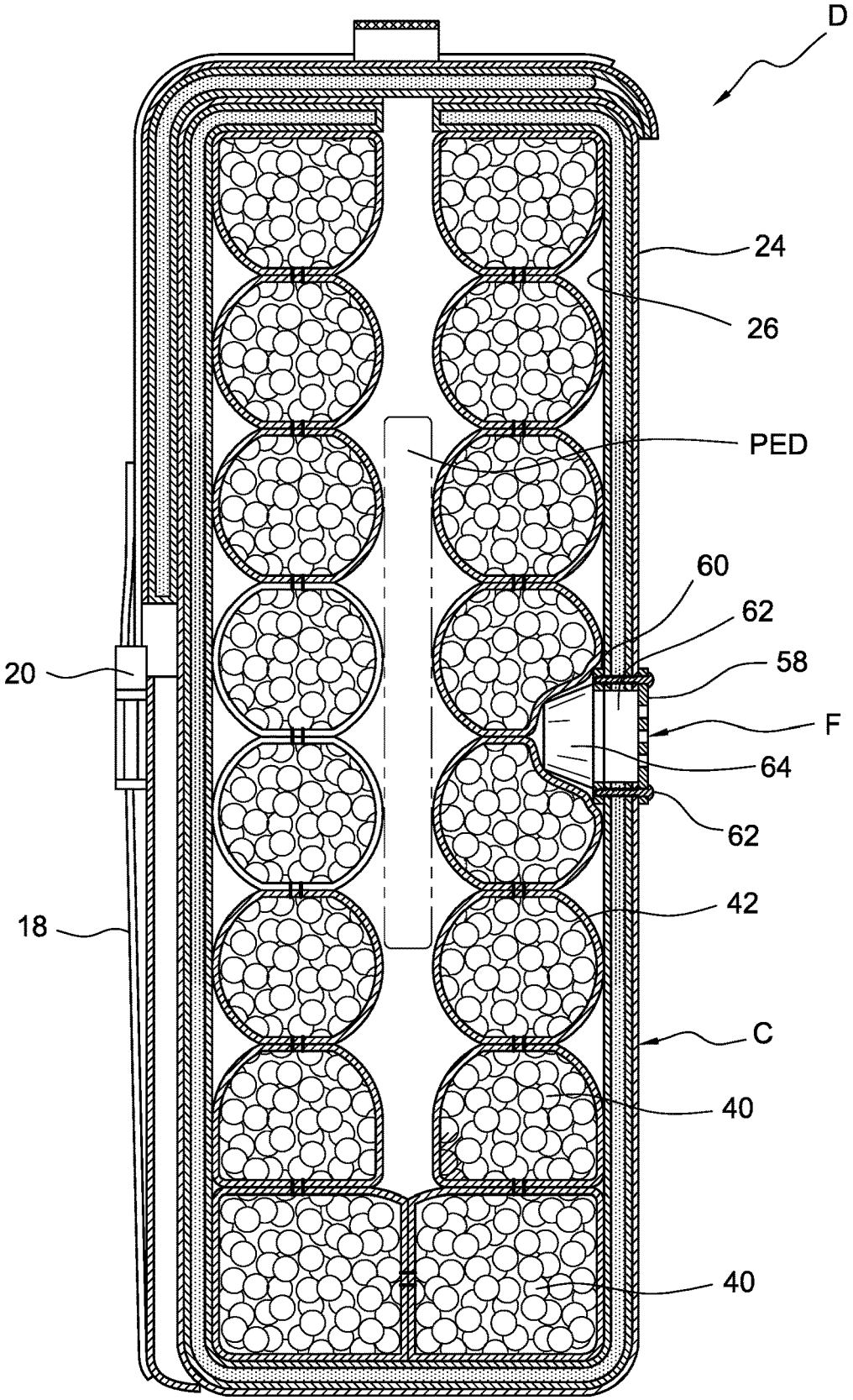
FIG. 11 is a cross sectional view of another embodiment of the device that is shown in FIG. 4.

FIG. 11 illustrates the fire containment device D of fitted with a filtering device F. An ignited PED will generate gas and smoke when deposited within device D, in the FIG. 11 embodiment the gases are filtered and then vented from the interior of the device to prevent excessive pressure from building up inside the device D.

The filtering device F is shown to comprise an outer perforated gasketed plate 58 and an inner gasketed plate 60 interconnected by screws 58 to provide a passageway 62 that extend from the interior of the container C to its exterior. A commercial grade organic vapor filter 64 is fitted over the inner gasketed plate 60. The filter 64 is shown adjacent the innermost layer 26 of container C and baffles 42. It is within the scope of the present invention to extend or otherwise position the filter so that it is disposed beyond baffles 42 and will lie within the most interior region of container C. As is apparent, it is within the scope of the present invention to provide other filtering devices to filter gas and smoke generated within the bag during a fire event so that it can be released from the bag.

Figure 12:
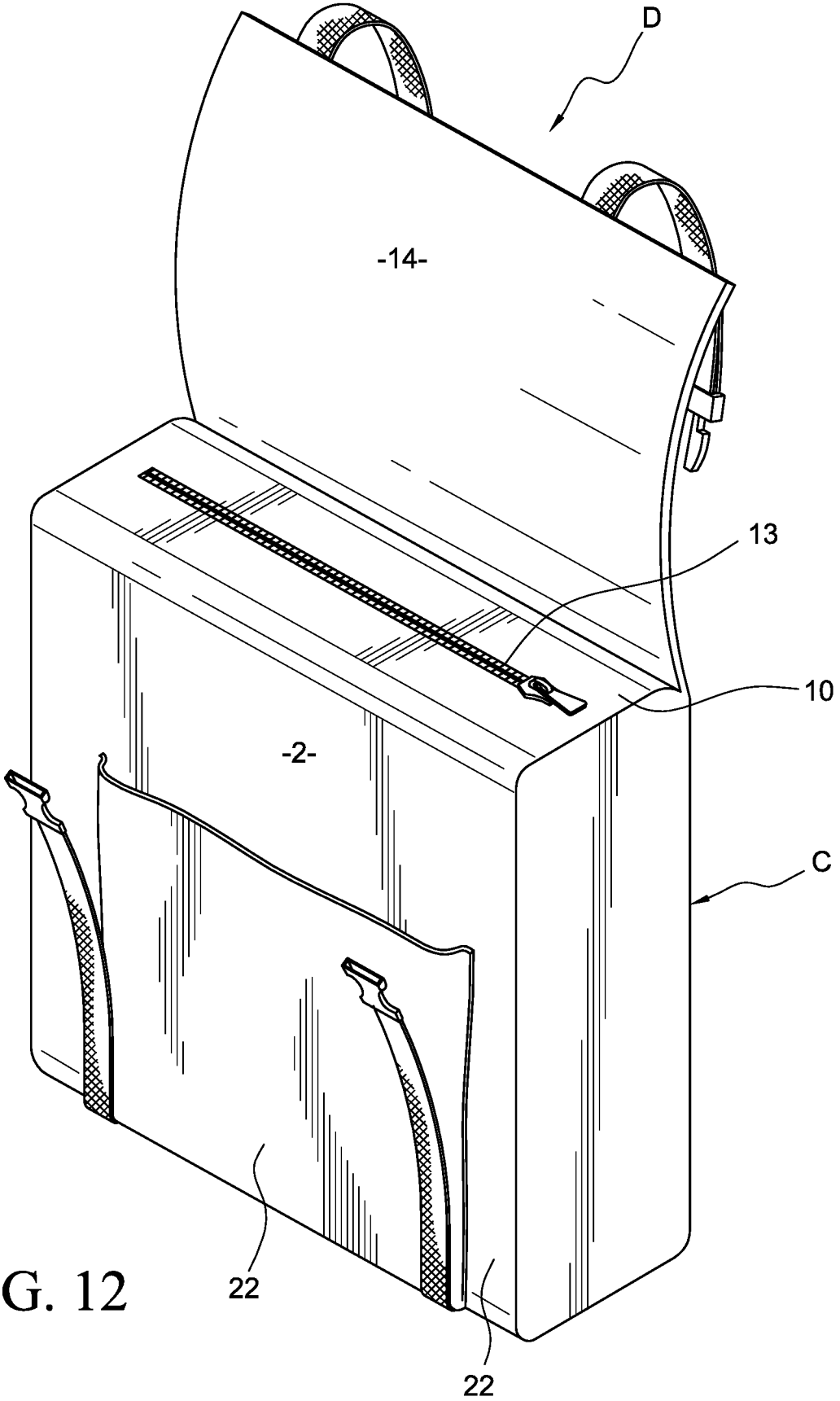
FIG. 12 is a perspective view of another embodiment of the device according to the present invention.

FIG. 12 illustrates another embodiment of the present invention where opening 12 of the container C is provided with a waterproof and airtight zipper closure 13. As is apparent, other zipper closures are within the scope of the present invention.

While this invention has been described as having a preferred design, it is understood that it is capable of further modifications, uses and adaptations, both in whole and in part, while following the general principle of the invention including such departures from the present disclosure as is known or customary practice in the art to which this invention pertains, and as may be applied to the central features of this invention.

We claim:

1. A fire containment device comprising:

a) a container having an opening for access to a container interior;

b) a closure for the container opening; and c) a liner filled with free-flowing expanded glass granulate having fire extinguishing properties provided within the container interior, the liner contains a plurality of sealed compartments to separately retain the free flowing granulate within defined regions of the container interior, each of the plurality of compartments is connected to an adjacent compartment, the liner having first and second opposite liner portions that are spaced apart from each other so as to form a cavity region within the interior of the container, the liner is formed from a sacrificial material that is adapted to disintegrate upon exposure to heat whereby when a device that has caught fire is placed into the container cavity, the free-flowing expanded glass granulate is released from the liner onto the device to extinguish the fire.

2. A device as in claim 1 wherein the container has an interior wall defining the interior of the container and an exterior wall defining an exterior of the container, the plurality of compartments are aligned in a parallel relation and are adjacent the interior wall of the container.

3. The device as in claim 1 and wherein the free-flowing expanded glass granulate comprises foamed silicon dioxide glass spheres.

4. The device as in claim 3 and wherein the foamed silicon dioxide glass spheres have a diameter between about 1 mm to about 4 mm.

5. The device as in claim 4 and wherein the foamed silicon dioxide glass spheres are provided as a blend of spheres having a diameter of 1 mm, 2 mm, 3 mm and 4 mm and in a ratio of 1:1:1:1.

6. The device of claim 1 and wherein the closure is selected from the group consisting of flaps, hook and loop connectors and zippers.

7. The device as in claim 2 and further including a filter, the filter disposed within the container interior and is secured to the interior wall.

8. The device as in claim 1 and wherein the liner is formed from a flammable fabric material.

9. The device as in claim 2 and wherein the plurality of compartments have a generally annular shape.

10. The device as in claim 7 and wherein the filter includes a vent from the interior wall to the exterior wall of the container.

11. The device as in claim 2 and wherein the liner is secured to the interior wall of the container.

12. The device as in claim 1 and wherein the plurality of compartments have a uniform shape.

13. The device as in claim 1 and wherein at least some of the plurality of compartments are aligned transverse to the longitudinal axis of the container.

14. A fire containment kit comprising:

a) a container having an opening for access to a container interior, a closure for the container opening, an exterior sleeve, and a liner filled with free-flowing expanded glass granulate having fire extinguishing properties provided within the container interior, the liner contains a plurality of closed compartments to separately retain the free flowing granulate within defined regions of the container interior, each compartment of the plurality of compartments is connected to an adjacent one of the plurality of compartments, the liner having first and second opposite liner portions that are spaced apart from each other so as to form a cavity region within the interior of the container, the liner is formed from a sacrificial material that is adapted to disintegrate upon exposure to heat whereby when a device that has caught fire is placed into the container cavity, the free-flowing expanded glass granulate is released from the liner onto the device to extinguish the fire;

b) fire-resistant gloves; and c) a fire-resistant blanket wherein the gloves and the blanket are stored in the container sleeve.

15. A fire container for receiving a device that has caught fire comprising:

a) a container having an opening for access to a container interior, the container having at least first and second interior walls defining an interior of the container and an exterior wall defining an exterior of the container;

b) a closure for the container opening; and c) a liner filled with free-flowing expanded glass granulate having fire extinguishing properties provided within the container interior, the liner contains a plurality of closed compartments to separately retain the free-flowing expanded glass granulate within defined regions of the container interior, the liner includes first and second opposite liner portions configured to contact a device placed within the container, the liner is formed from a sacrificial material that is adapted to disintegrate upon exposure to heat whereby when a device that has caught fire is placed in the container interior, the free-flowing expanded glass granulate is released from the liner and onto the device to extinguish the fire.

16. The fire container as in claim 15 and further including a filter and vent, the filter and vent extend between the exterior wall to one of the first and second interior walls.

17. The fire container as in claim 15 and wherein at least a portion of the container opening is aligned between the first and second opposite liner portions.

18. The fire container as in claim 15 and wherein the plurality of compartments extend transverse to the longitudinal axis of the container.

19. The fire container as in claim 15 and wherein the first and second opposite liner portions are secured to respective first and second interior walls.

20. The fire container as in claim 15 and wherein the plurality of sealed compartments have an annular shape.

* * * * *